US006006670A

United States Patent [19]

Bantlin et al.

[11] Patent Number: 6,006,670

[45] Date of Patent: Dec. 28, 1999

[54] DEVICE FOR HANDLING A SHEET PILE IN A PRINTING PRESS

[75] Inventors: Michael Bantlin, Wiesloch; Willi Egles, Bad Schoenborn; Oliver Gottschalt, Ludwigshafen, all of Germany

[73] Assignee: Heidelberger Druckmaschinen AG, Heidelberg, Germany

[21] Appl. No.: 09/009,603

[22] Filed: Jan. 20, 1998

[30] Foreign Application Priority Data

Jan. 18, 1997 [DE] Germany ..... 197 01 645

[51] Int. Cl.[6] ..... B65G 57/00

[52] U.S. Cl. ..... 101/494; 101/DIG. 35

[58] Field of Search ..... 101/494, DIG. 35; 414/789.7, 789.9

[56] References Cited

U.S. PATENT DOCUMENTS

| | | | |
|---|---|---|---|
| 3,770,142 | 11/1973 | Zernov et al. | 414/790.3 |
| 4,565,129 | 1/1986 | Simeth et al. | 101/240 |
| 4,926,220 | 5/1990 | Matysek et al. | 414/789.9 |
| 5,520,504 | 5/1996 | Zahn | 414/790.7 |

FOREIGN PATENT DOCUMENTS 9307926 9/1993 Germany .

*Primary Examiner*—Ren Yan
*Assistant Examiner*—Daniel J. Colilla
*Attorney, Agent, or Firm*—Herbert L. Lerner; Laurence A. Greenberg

[57] ABSTRACT

A device for handling a sheet pile in a printing press includes a pile chamber with at least one opening of a size at least through which the pile is passable horizontally, a lifting platform in the pile chamber for receiving the sheet pile thereon, a lift drive for vertically adjusting the platform, and a screen assigned to the opening and adjustable between a first operating condition wherein the screen covers the opening, and a second operating condition wherein the opening is free from being covered by the screen. A conveyor section horizontally shifts the pile through the opening when the lifting platform is at a transfer level. The conveyor section includes a first conveyor subsection within the pile chamber and at least a second conveyor subsection outside and adjoining the pile chamber. The first and second subsections have alternating states of occupancy during operation. They are alternately occupied by a pile and not occupied by a pile. A conveyor section drive shifts the pile along the conveyor section. The screen is operationally independently changeable from the first to the second operating state for predetermined states of occupancy of the conveyor subsection and when the lifting platform is at the transfer level and, the screen is operationally independently changeable from the second to the first operating state thereof after the pile has been shifted completely from one of the conveyor subsections to the other.

9 Claims, 8 Drawing Sheets

DEVICE FOR HANDLING A SHEET PILE IN A PRINTING PRESS

BACKGROUND OF THE INVENTION

Field of the Invention

The invention relates to a device for handling a sheet pile in a printing press, including a pile chamber formed with at least one opening which is of a size at least through which the sheet pile is passable in a horizontal direction, a lifting platform disposed in the pile chamber for receiving the sheet pile thereon, a reciprocating drive for vertically adjusting the lifting platform, and a screen assigned to the opening and being adjustable between a first operating condition wherein the screen covers the opening, and a second operating condition wherein the opening is free from being covered by the screen.

Printing presses equipped with such devices have been marketed by Heidelberger Druckmaschinen A. G. under the model designation SM102. The screen encompasses an adjustable bracket which, in a first position, extends crosswise over the opening formed in the pile chamber in the manner of a railing and represents thereat a first operating condition of the screen wherein, at least during the production run, unhindered access to the sheet pile chamber through the opening is blocked by the bracket. Moreover, the screen also encompasses a switch arrangement actuatable by the bracket for stopping the reciprocating drive of the lifting platform. A corresponding actuation of the switch arrangement is effected upon a change from the aforementioned first operating condition of the screen to a second operating condition thereof, specifically by shifting the bracket into a position thereof wherein the opening is not covered by the screen.

This conventional screen is provided whenever the printing press is mounted on a foundation projecting above the level of the floor at the location at which the printing press is installed and permits longer adjusting paths of the lifting platform and, consequently, higher sheet piles to be handled than is possible with an installation which is flat on the floor.

In the printing presses equipped with a conventional screen, sheet pile handling is effected, through the intermediary of manual lift carriages or the like, by a conveyor or feeder actuated by a machine operator.

SUMMARY OF THE INVENTION

It is accordingly an object of the invention to provide a device for handling a sheet pile in a printing press which is largely automated and simultaneously affords an assurance of adequate protection against moving parts which are associated with the build-up or dismantling of the sheet pile.

With the foregoing and other objects in view, there is provided, in accordance with the invention, a device for handling a sheet pile in a printing press, including a pile chamber formed with at least one opening which is of a size at least through which the sheet pile is passable in a horizontal direction, a lifting platform disposed in the pile chamber for receiving the sheet pile thereon, a lift drive for vertically adjusting the lifting platform, and a screen assigned to the opening and being adjustable between a first operating condition wherein the screen covers the opening, and a second operating condition wherein the opening is free from being covered by the screen, comprising a conveyor section for horizontally shifting the pile through the opening when the lifting platform is at a transfer level, the conveyor section including a first conveyor subsection disposed within the pile chamber and at least a second conveyor subsection located outside and adjoining the pile chamber, the first and second conveyor subsections having alternating states of occupancy during operation, wherein they are alternately occupied by a pile and not occupied by a pile, respectively; a conveyor section drive for shifting the pile along the conveyor section; the screen being operationally independently changeable from the first to the second operating state thereof for predetermined states of occupancy of the conveyor subsection and when the lifting platform is at the transfer level and, the screen being operationally independently changeable from the second to the first operating state thereof after the pile has been shifted completely from one of the first and second conveyor subsections to the other thereof.

In accordance with another feature of the invention, the handling device includes a stop signal generatable by the screen when the screen departs from the first operating state thereof, at least the lift drive being triggerable by the stop signal for shutting the lift drive down when an adjustment of the lifting platform is in progress.

In accordance with a further feature of the invention, the screen comprises a gate.

In accordance with a first alternative feature of the invention, the screen comprises a rollup shutter.

In accordance with a second alternative feature of the invention, the screen comprises a radiation curtain, a stop signal being generatable by the radiation curtain when an intervention into the curtain occurs, at least the lift drive being triggerable by the stop signal for shutting the lift drive down when an adjustment of the lifting platform is in progress.

In accordance with a concomitant feature of the invention, a emergency-stop signal is generatable by the radiation curtain when an intervention into the curtain occurs, the emergency-stop signal being applicable for shutting the printing press down.

In such an embodiment of the device according to the invention, shifting of the sheet pile occurs automatically between adjacent destinations, in this case, particularly, the pile chamber and an adjoining buffer zone, while adequate protection against moving parts associated with the buildup and dismantling, respectively, of a sheet pile is assured by providing that the opening have an independently acting screen assigned thereto, which uncovers the opening only whenever unhindered access to the pile chamber is impossible anyway due to a shifting of the pile through this opening.

The aforementioned protection against moving parts is, moreover, highly reliable, in the sense that, because of the automatic assumption of the respective operating state of the screen, it does not depend upon the care with which an operator, in the event of a manually actuated screen, reestablishes thereat the first operating state or, in other words, the screening off of the opening after the opening has been uncovered.

As provided, for example, in the type of printing press mentioned at the introduction hereto and sold by the corporate assignee of the instant application, the lifting platform in the delivery, which releases the sheets from revolving gripper systems so that they can be deposited, can be lowered by the lift drive as a result of actuating a key, in addition to the provided programmed lowering thereof which is performed in order to preserve the same drop height of the sheets after they have been released by the gripper systems.

A person entering the pile chamber during this process runs the risk of pinching injuries, particularly in the vicinity of his or her foot. Such an entry by a person might become necessary, for example, by an external intervention into the screen, with the intent of making the opening accessible. An external intervention of this type might, if necessary or desirable, involve overcoming an adjusting force, in a case wherein the screen is formed by a gate or a rollup shutter, by which force the gate or rollup shutter has been kept in a position wherein the opening is screened off.

A refinement of the subject of the invention offers protection against these pinching injuries also in the event someone enters the pile chamber inappropriately. To that end, a stop signal, which can be generated by the screen when it departs from the first operating state thereof, is provided, at least the lift drive being triggerable towards shutting the lift drive down when an adjustment of the lifting platform is in progress.

Whereas, forming the screen as a gate provides adequate protection along the lines mentioned, in an embodiment of the screen as a rollup shutter, the possibility exists of keeping the opening of the pile chamber closed, at least virtually completely, in the first operating state of the screen.

Similar conditions to those with the aforementioned rollup shutter can be achieved by forming the screen as a radiation curtain, and providing that a stop signal be generatable by the radiation curtain when an intervention occurs into this curtain, at least the lift drive being triggerable by this stop signal towards shutting the lift drive down when an adjustment of the lifting platform is in progress.

This construction, moreover, has the advantage that the respective change from one operating state of the screen to another takes place practically all at once.

Securing the opening by the aforementioned radiation curtain, in comparison with constructing the screen as a gate, for example, means that there is no direct recognizable barrier to entering the pile chamber purposefully. In this sense, in a further feature of the screen formed as a radiation curtain, a emergency-stop signal, which can be generated by the radiation curtain when an intervention occurs therein, is used for shutting down the printing press.

With this feature, in addition to guarding against the aforementioned pinching injuries in the vicinity of the foot of a human operator, another safety risk is precluded, which can occur, for example, in the pile chamber of a chain delivery when, despite a stopped lift drive, gripper bars can continue to revolve and can possibly threaten the head region of a human operator.

Other features which are considered as characteristic for the invention are set forth in the appended claims.

Although the invention is illustrated and described herein as embodied in a device for handling a sheet pile in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
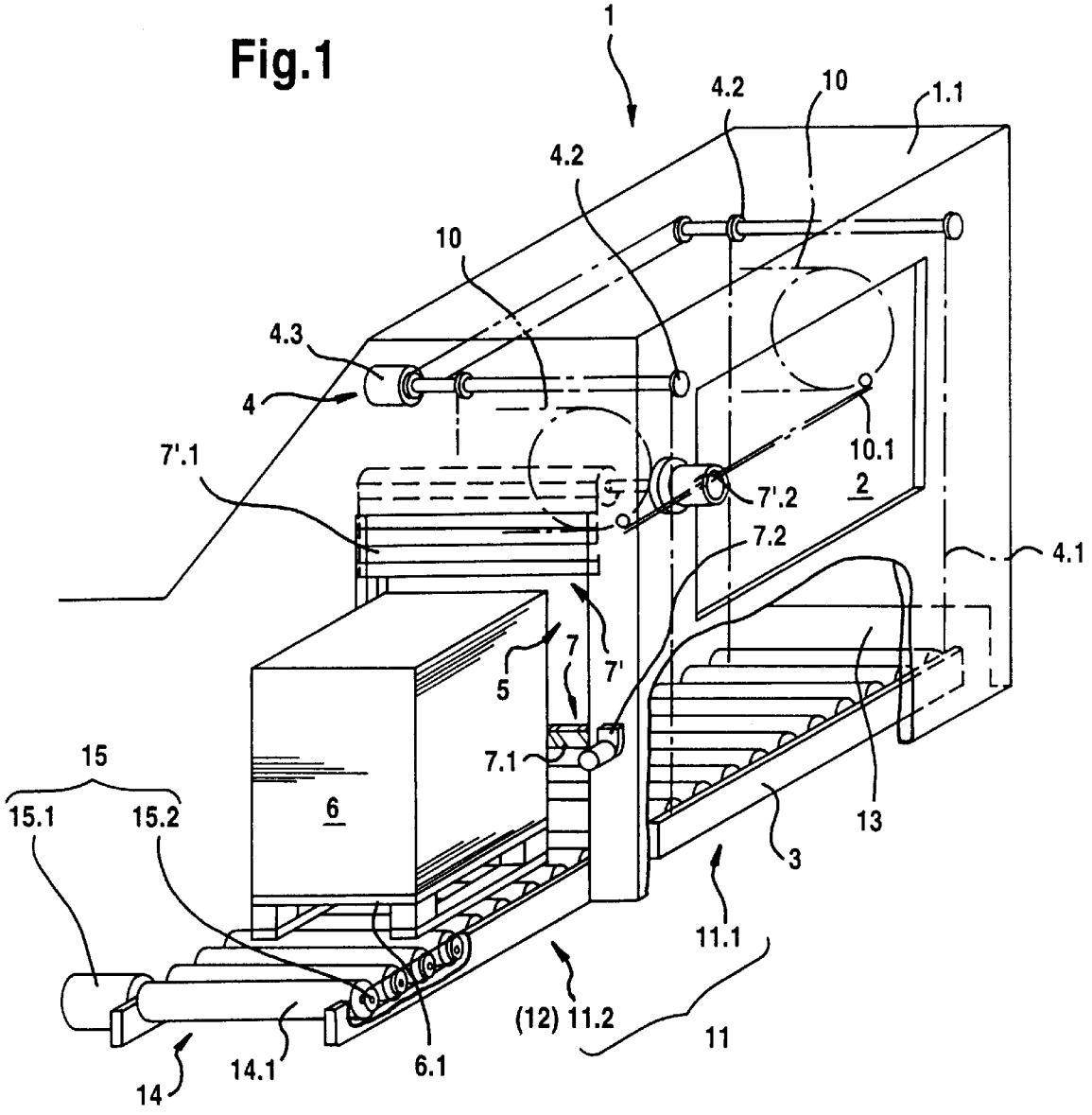
FIG. 1 is a simplified diagrammatic front, side and top perspective view of the pile-handling device according to the invention, which is made up of components of a chain delivery and a screen formed as a gate or a rollup shutter.

Referring now to the drawings and, first, particularly, to FIG. 1 thereof, there is shown therein a chain delivery 1 illustrating, for example, one of the possible applications of the pile-handling device according to the invention, and provided with a predominantly closed delivery housing 1, which encloses a sheet-pile or stack chamber 2. Disposed in the pile chamber 2 is a lifting platform 3, which is engaged by a stroke or lifting drive 4. In the illustrated embodiment of FIG. 1, the stroke or lifting drive 4 includes load chain sides or runs 4.1 carrying the lifting platform 3, as well as chain drive wheels 4.2 disposed in an upper region of the pile chamber 2 and having the load chain runs or sides 4.1 slung around them, the chain drive wheels 4.2 being driven by a lifting motor 4.3 in a first and second direction of rotation, respectively, for vertically adjusting the lifting platform 3. In the view of FIG. 1, the lifting platform 3 is disposed in an extremely lower position and, thus, in the case of the exemplary embodiment of the chain delivery 1 shown in this figure of the drawings, assumes a so-called transfer level.

The sheet pile chamber 2 has an opening 5 of such size at least that the sheet pile 6, when shifted horizontally, can pass therethrough, if the lifting platform 3 is located at the transfer level thereof. This opening 5 has a screen 7 and 7', respectively, assigned thereto, by which the opening 5 can be screened off in a manner described hereinafter.

Figure 2:
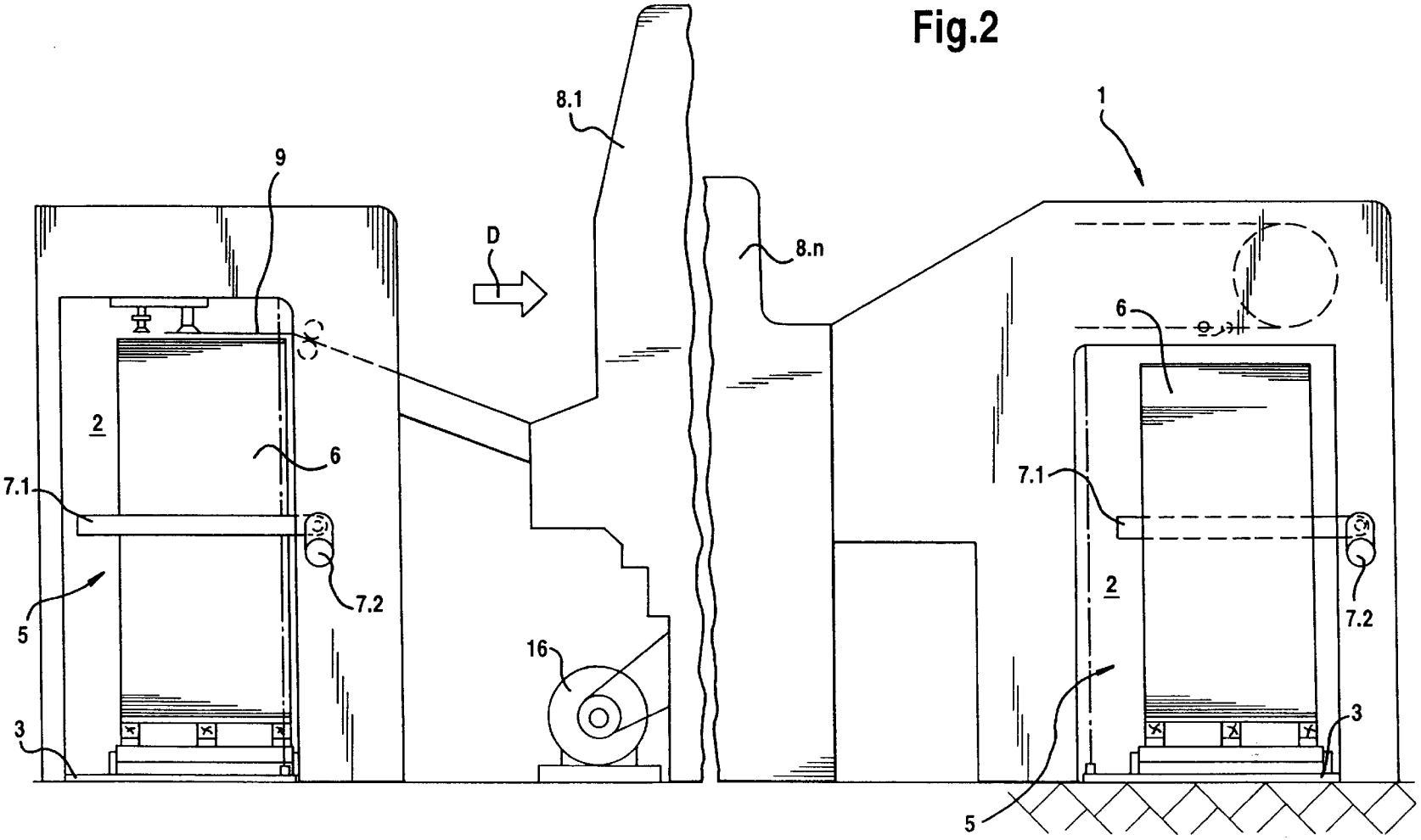
FIG. 2 is a diagrammatic side elevational view, partly broken away, of a combination of two of the pile-handling devices according to the invention, respectively, in the form of a feeder and a delivery, for example, a chain delivery, and a connection thereof to a respective processing unit of a printing press.

Taking into account the connection of the chain delivery 1, as shown in FIG. 2, to a processing unit 8.n of the printing press (in the case wherein n processing units 8.1 to 8.n are provided), the processing unit 8.n being embodied as a printing unit, a photoresist or varnishing unit, an imprinting or overprinting unit, a perforating unit, or the like, optionally with a dryer located downstream therefrom, and further taking into account the direction of travel represented by the arrow D of sheets 9 singly separated from the sheet pile 6, it is readily apparent that the opening 5 is formed in a side wall of the delivery housing 1.1. This is certainly advantageous from a logistical standpoint but is not mandatory for the construction of the device according to the invention.

The opening 5 is provided so that, in the embodiment of the delivery shown in FIG. 1, a sheet pile 6, which is being formed in the pile chamber 2 thereof during the production run of the processing units 8.1 to 8.n, can be removed by horizontally shifting the sheet pile 6 out of the pile chamber 2 after the sheet pile 6 has attained a predetermined height, the growth of the sheet pile 6 being effected by a respective gripper system 10.1, pivotably connected to revolving conveyor chains 10 like the conveyor chains 10 shown only diagrammatically in FIG. 1, the gripper system 10.1 taking up a respective sheet 9 from the processing unit 8.n in accordance with the processing cycle of the processing units 8.1 to 8.n, transporting it into the sheet pile chamber 2, and releasing it thereat for building up the pile 6 on a pile support 6.1.

When the lifting platform 3 is disposed at the transfer level, the aforementioned horizontal shifting of the sheet pile 6 for the purpose of removing it from the pile chamber 2 through the opening 5 is effected along a conveyor route or section 11 provided for this shifting. The conveyor section 11 is composed of a first conveyor subsection 11.1 disposed within the pile chamber 2, and a second conveyor subsection 11.2 disposed outside the pile chamber 2 and adjoining the first conveyor subsection 11.1 in the vicinity of the opening 5. In the embodiment shown in FIG. 3, the second conveyor subsection 11.2 is dimensioned as only just large enough so that it can act as a buffer zone 12 for the pile 6 shifted out of the pile chamber 2 through the opening 5.

Figure 3:
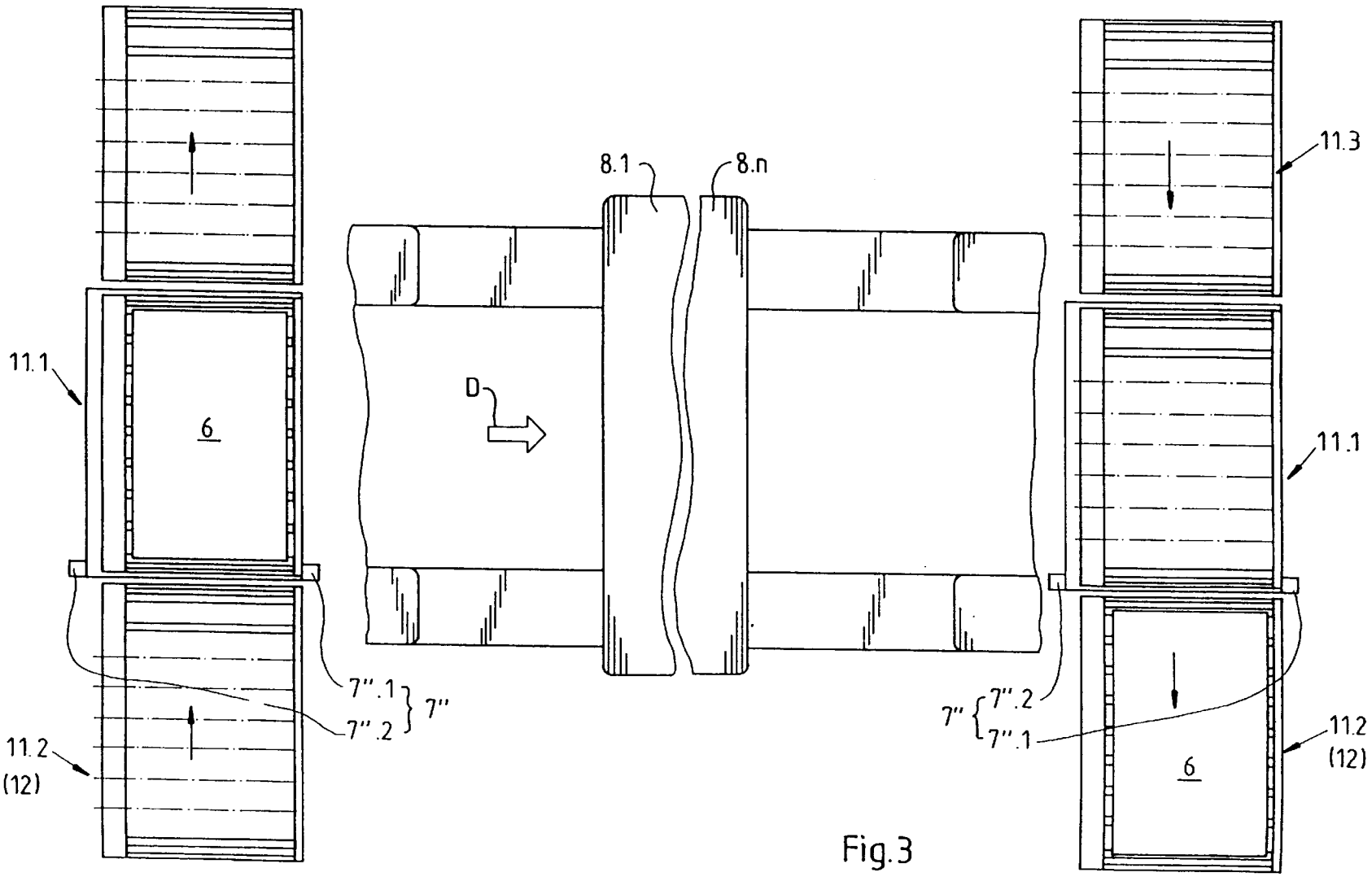
FIG. 3 is a top plan view of FIG. 2, wherein the feeder and the delivery are cut away to an extent that conveyor subsections are recognizable.

Immediately after or simultaneously with the shifting of the pile 6 from the pile chamber 2 to the buffer zone 12, the lifting platform 3 located at the transfer level is covered by a further pile support 6.1 and then raised by the lifting or stroke drive 4 to a given level for receiving additional sheets released by the gripper systems 10.1, and then lowered again at a rate at which the further-developing pile increases in height. For the purpose of equipping the lifting platform 3 with the support 6.1 for the further-developing pile 6, the side wall of the delivery housing 1.1 located opposite the opening 5 is provided with at least one charging opening 13. Advantageously, at the end of the first conveyor subsection 11.1 towards the charging opening 13, a further conveyor subsection 11.3 located farther outside the pile chamber 2 adjoins the first conveyor subsection 11.1 as shown in FIG. 3; as is readily apparent, the further conveyor subsection 11.3 is omitted from FIG. 1, nor is there shown therein the aforementioned further pile support 6.1 on the lifting platform 3.

A respective one of the conveyor subsections 11.1, 11.2 and 11.3 is represented in the embodiment at hand by a roller gang or series 14, with which there is associated a component of a conveyor route or section drive 15 in the form of a motor 15.1 connected to a first roller of a plurality of transport rollers 14.1 forming the roller gang 14, and in the form of a transmission 15.2 which transmits rotary motion of the respective first roller of the transport rollers 14.1 in the respective roller gang 14 to the other rollers in that roller gang 14. In only an exemplary construction, the aforementioned transmission 15.2 is embodied as a chain transmission having sprocket wheels which are secured to the ends of the transport rollers 14.1 and are connected to one another by endless chains, so as to revolve in the same rotational sense. Another manner of constructing the conveyor subsections is derivable, for example, from FIGS. 9 and 12 of U.S. Pat. No. 5,520,504 and the description associated therewith.

Under the action of the conveyor route or section drive 15, the pile 6 is shiftable along the conveyor route or section 11. In FIG. 1, only the component of the conveyor route or section drive 15 associated with the first conveyor subsection 11.1 is shown.

The first conveyor subsection 11.1 is disposed mainly so that it is possible to shift the pile 6 therewith when the lifting platform 3 is at the transfer level. In this regard, the first conveyor subsection 11.1 may be carried by the lifting platform 3 or may be disposed locally stationary at the same level as the second conveyor subsection 11.2. In the latter case, the first conveyor subsection 11.1 and the lifting platform 3 should be embodied so that the latter, upon being adjusted in the direction of the transfer level, sets the pile 6 down on the first conveyor subsection 11.1.

FIG. 1 illustrates a phase in the course of operation of the device according to the invention wherein the pile 6, which has previously been formed in the pile chamber 2, has already been shifted out of a position inside the pile chamber 2 through the opening 5 into a second position wherein it now occupies the buffer zone 12 which had previously not been occupied by a pile. Accordingly, the buffer zone 12 has changed from a previous occupancy state, namely, "not occupied by a pile" to a state "occupied by a pile".

Furthermore shown in FIG. 1 are two different embodiments of the screen previously discussed hereinabove and identified by reference characters 7 and 7'. Naturally, these may be provided alternatively. In a first embodiment, the screen 7 has a gate or barrier 7.1. It may assume a first and a second operating state, and is shown in FIG. 1 in a first operating state or phase thereof, wherein it is closed or, in other words, disposed crosswise to the opening 5, thereby screening the opening 5 off. In the second operating state or phase of the gate 7.1, it is open or, in other words, is pivoted upwardly or downwardly to uncover the opening 5 so that the pile 6 can pass therethrough. A corresponding pivoting of the gate 7.1 is effected by a pivot drive 7.2, which is embodied in FIG. 1, by way of example, as a motor-gear transmission unit acting upon the pivot axis of the gate 7.1 and disposed, only by way of example, on the side wall of the delivery housing 1.1 wherein the opening 5 is formed.

In a second embodiment, the screen 7' includes a rollup shutter 7'.1. This shutter is suspended above the opening 5 in the delivery housing 1.1 and is rolled down, in a first operating phase, wherein it screens the opening 5, and is rolled up, in a second operating phase, wherein it uncovers the opening 5. It is rolled up and down by a rotary drive 7'.2, which is connected to a windup core of the rollup shutter 7'.1 and is constructed in this embodiment, for example, as a motor-transmission gear unit, as well, and which, like the pivot drive 7.2, is shown in FIG. 1 as being secured to the delivery housing 1.1 from the outside, only for clarifying the functional relationship.

In a further embodiment, as represented in FIG. 3, the screen 7" is constructed to provide a radiation curtain which screens off the opening 5 and, in this regard, it includes a transmitter console or bracket 7".1 and a receiver console or bracket 7".2, respectively, shown in cross section. In the case wherein the radiation curtain is formed by beams of light, commercially available safety beam gates can be employed for the transmitter console 7".1 and receiver console 7".2, and can be ordered from the firm Erwin Sick GmbH Optik-Elektronik, 79183 Waldkirch, Germany, by model numbers AGS300 through AGS1200, of which "300" and "1200" represent the respective heights of the beam gate.

The realization of an operationally independent change in operating states of the screen is achieved by a control system which is described in detail hereinafter. The control system includes signal transducers, which are addressed hereinafter in further detail in terms of the block circuit diagram of FIG. 4 for the case wherein the device according to the invention is equipped with a screen 7 in the form of the gate 7.1, and a control circuit 17, which establishes a linkage between the signal transducers and the conveyor route or section drive 15 for horizontally shifting the pile 6, with the pivot drive 7.2, the rotary drive 7'.2 and the transmitter console 7".1, respectively, and the receiver console 7".2 for varying the operating states of the screens 7, 7' and 7", respectively, and with the lifting motor 4.3, as well as in the case of the aforementioned embodiment for meeting more-stringent safety demands, in accordance with the flow chart of FIG. 8, with the main drive motor 16 of the printing press (note FIGS. 4 and 2).

Figure 4:
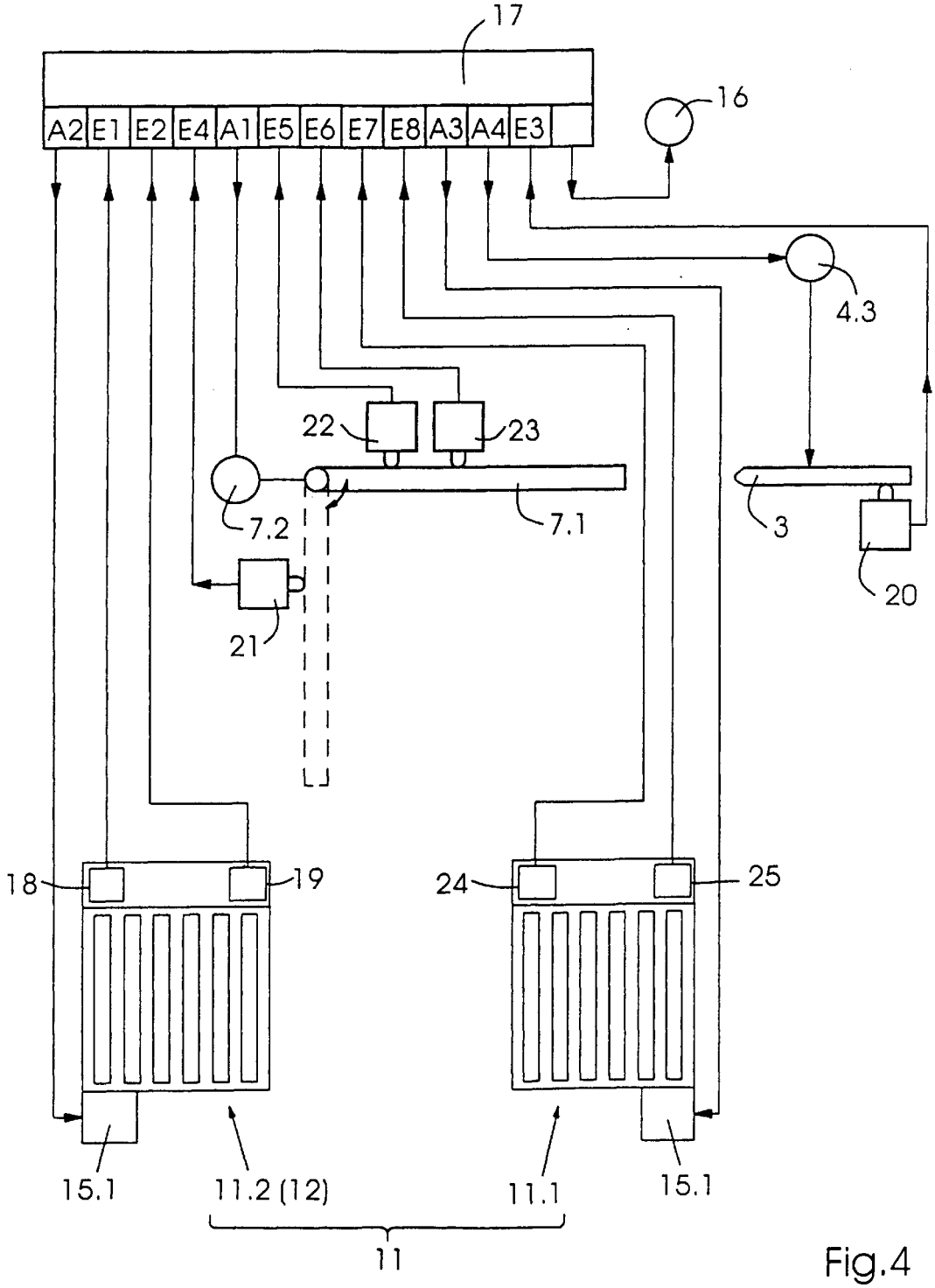
FIG. 4 is a schematic and block circuit diagram of controls for realizing the function of the pile-handling device according to the invention.

The block circuit diagram of FIG. 4 showing the aforementioned linkage conforms with the example shown in FIG. 1 of the apparatus functioning as a delivery and for the construction of the screen 7 as a gate 7.1. According to FIG. 4, the motors 15.1 of the conveyor route or section drive 15 for shifting the pile 6 along the conveyor route or section 11 are controllable or can be triggered by the control circuit 17 encompassed by the control system. According to the flow chart of FIG. 5, the triggering of the motors 15.1 for shifting the pile 6 (in the case of the delivery shown in FIG. 1, from the first conveyor subsection 11.1 within the pile chamber 2 to the buffer zone 12 formed by the second conveyor subsection 11.2 outside the pile chamber 2) as a function of the occupancy phase or stage of the buffer zone 12 and as a function of the location of the lifting platform 3 at the transfer level thereof. To ascertain the occupancy state or phase of the buffer zone 12, two signal transducers 18 and 19, formed as reflected light scanners in the embodiment of FIG. 4, are assigned to the buffer zone 12 so that a respective one of the two signal transducers 18 and 19 is disposed opposite a respective one of opposed ends of a correctly positioned pile support 6.1 which may be occupying the buffer zone 12. Signal transducers in the form of reflective light scanners are available in the marketplace and, for the application at hand, may be procured, for example, from the firm Visolux in Berlin, Germany under the model number MLV40-8-H/33/47.

To determine whether or not the further condition for shifting the pile, namely, "lifting platform at transfer level", is present, the lifting platform 3 has a signal transducer 20 in the form of a switch assigned thereto.

If the signal transducers 18 and 19 have applied the signals "buffer zone free" to the inputs E1 and E2 of the control circuit 17, and the signal "lifting platform at transfer level" has been applied by the signal transducer 20 to the input E3 of the control circuit 17, this circuit, via an output Al thereof, then triggers the pivot drive 7.2 to open the gate 7.1, and then, via outputs A2 and A3, triggers the motors 15.1 to shift the pile 6 from the first conveyor subsection 11.1 to the buffer zone 12, if shifting of the pile 6 is imminent.

In the production run mode of the printing press, in the case of the embodiment of the delivery including the device according to the invention shown by way of example in FIG. 1, the signal "lifting platform at transfer level" also implies the condition "shifting of the pile is imminent" because, in that case, when the lifting platform 3 reaches the extremely lowermost position thereof, the pile 6 has attained the maximum height thereof, and hence the fully loaded pile support 6.1 in the pile chamber 2 must be replaced by an empty pile support. In a manner analogous to that for the buffer zone 12, however, the first conveyor subsection 11.1 has signal transducers 24 and 25 assigned thereto, by which signals for "first conveyor route occupied with pile" can be applied, as a further prerequisite for pile shifting, to inputs E7 and E8 of the control circuit 17, so that the condition "pile shifting is imminent" can be met repeatedly.

Figure 5:
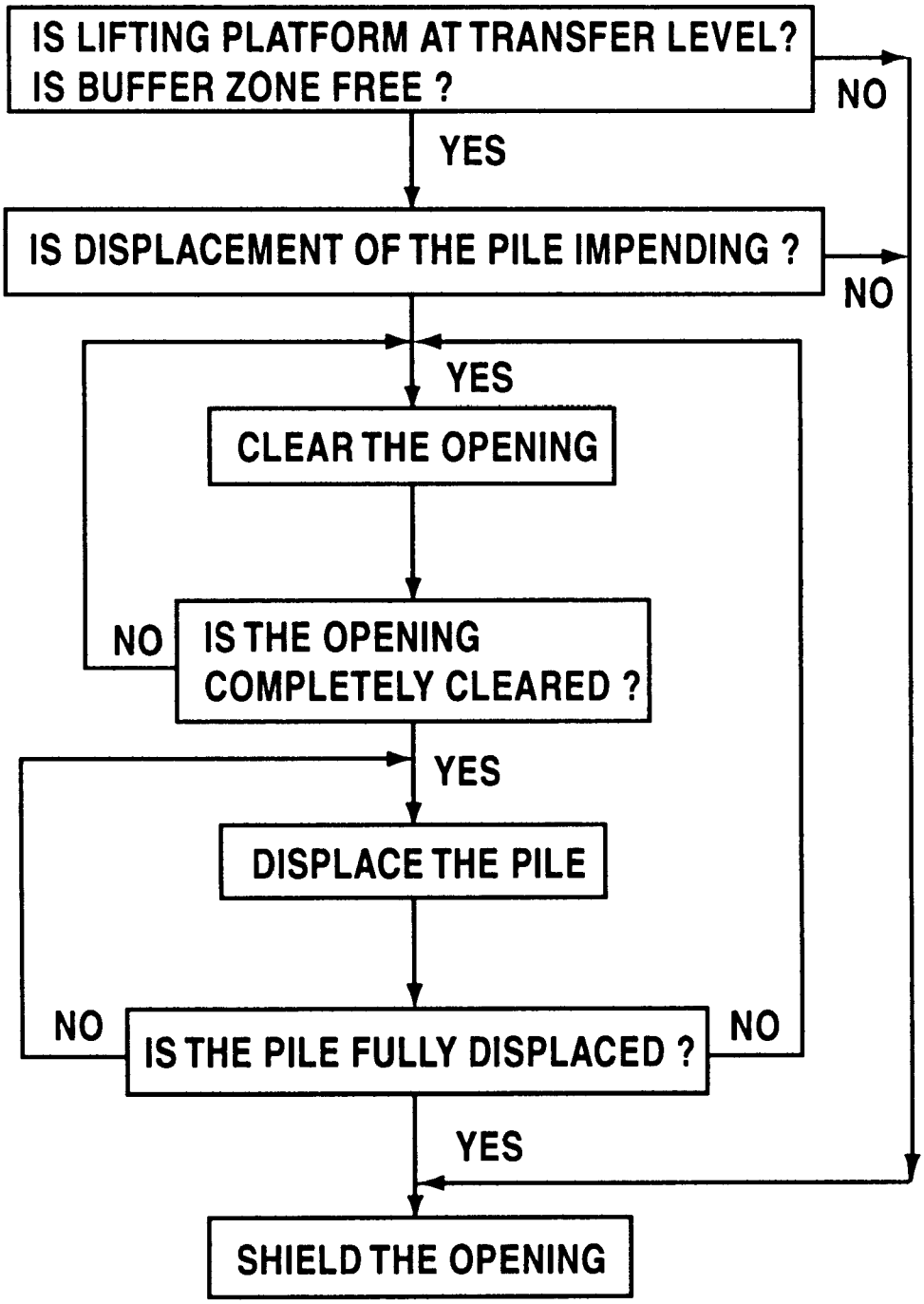
FIG. 5 is a flow chart of the operation of the pile-handling device when the sheet pile is shifted from a first conveyor subsection to a second conveyor subsection and the reverse, respectively, the screen of the device being constructed, for example, as a gate or a rollup shutter.

As is apparent from the flowchart of FIG. 5, the triggering of the motors 15.1 does not take place, however, until after the opening 5 has been uncovered completely, and the completely uncovered condition is also maintained only until such time as the pile 6 has been shifted completely or, in other words, until the pile 6 occupies the buffer zone 12 in a correct position.

For ascertaining whether the opening 5 has been completely uncovered, as shown in FIG. 4, a further signal transducer 21 is provided, which is actuated by the gate 7.1 only when this gate is completely open, and furnishes a corresponding signal to the input E4 of the control circuit 17.

The time period during which the pile 6 is shifted, and hence the time period during which the opening 5 is uncovered, ends with the correct positioning of the pile 6 in the buffer zone 12; this positioning is in turn ascertained by the signal transducers 18 and 19, and the result of this ascertainment is furnished via the inputs E1 and E2 in the form of a signal "buffer zone occupied with pile" transmitted to the control circuit 17, which thereupon triggers the pivot drive 7.2 to close the gate 7.1.

A further signal transducer 22 is operatively associated with the gate 7.1 in a manner that it is actuated by the gate whenever the gate is completely closed again or, in other words, whenever the opening 5 is properly screened. In this first operating state of the screen 7 formed by the gate 7.1, the signal transducer 22 outputs a corresponding signal to the input E5 of the control circuit 17, which thereupon triggers the pivot drive 7.2 in such a manner as to stop the latter.

The operating state "opening screened off" of the screen 7 formed of the gate 7.1 is queried in FIG. 4 by a further signal transducer 23 assigned to the gate 7.1, in fact, particularly for the case wherein the motor-transmission unit 7.2, provided as an example for actuating the gate 7.1, lacks any self inhibition to a possibly externally exerted influence upon the gate 7.1 in the direction of the opening thereof, or if the operative connection between the pivot drive 7.2 and the pivot axis of the gate 7.1 is effected by a slip coupling, or quite generally if a pivot drive 7.2 is provided which is adjustable by external forces (on the gate 7.1). At a departure from the first operating state of the gate 7.1 in response to some external influence, the signal transducer 23 outputs a corresponding signal "(external) intervention into the screen is occurring" to the input E6 of the control circuit 17, which thereupon, via the output A4 thereof, as shown in the flow chart of FIG. 6, outputs a signal "stop lifting motor", at least whenever the lifting motor 4.3 had been triggered to make a downward adjustment of the lifting platform 3, be it for lowering the pile 6 during operation to the extent that the pile height increases or, as noted hereinabove, for lowering the lifting platform 3 by actuating a key.

Figure 6:
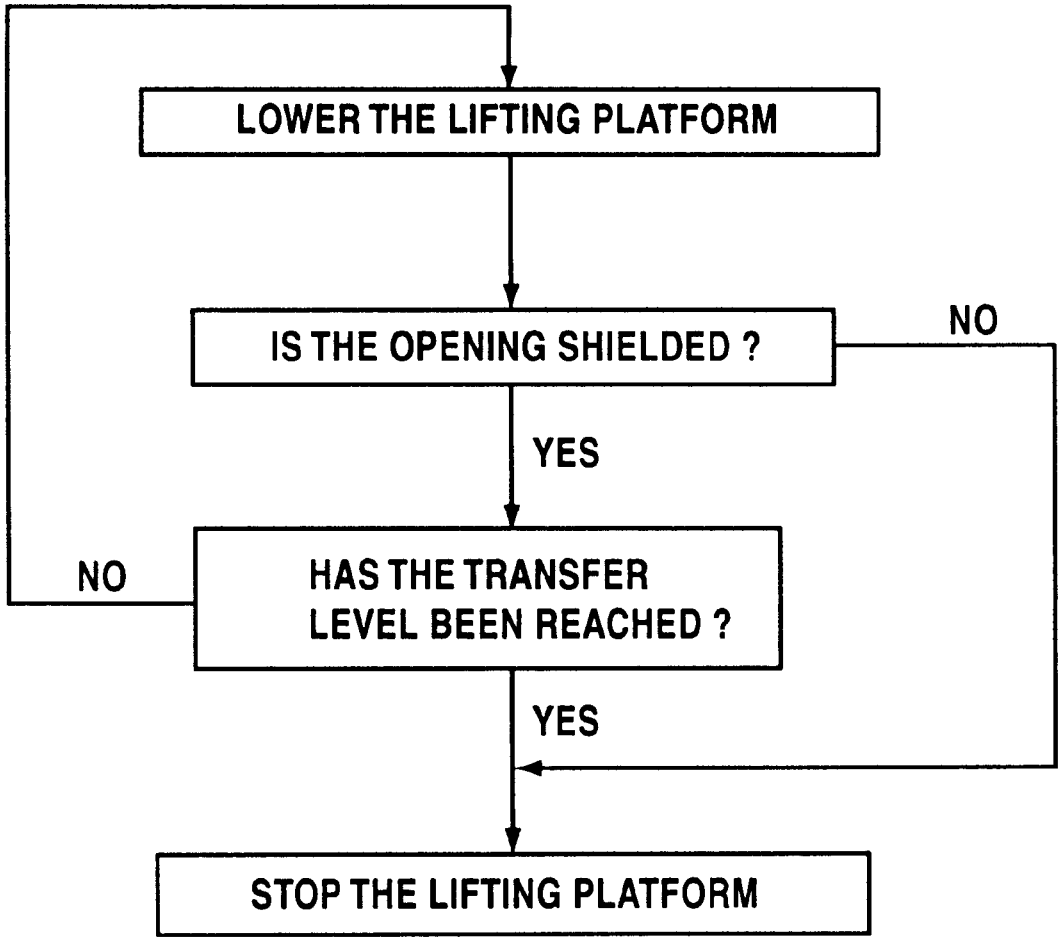
FIG. 6 is a flowchart of the operation of the pile-handling device in a downwardly-directed adjustment of the lifting platform, the screen of the device being constructed, for example, as a gate or a rollup shutter.

The flow charts shown in FIGS. 5 and 6 apply equally to the case wherein the device according to the invention is equipped with a screen 7' formed by the rollup shutter 7'.1. In that case, the functions exhibited in these flow charts can also be achieved with the control system described hereinabove and linked together in accordance with FIG. 4. In this regard, the signal transducers 21, 22 and 23 are assigned to the rollup shutter 7'.1 so that when the latter has been rolled all the way down, a corresponding signal "opening 5 screened off" can be applied by the signal transducer 22 to the control circuit 17, and a signal "rollup shutter is departing from the fully rolled-down state thereof" ("screen 7' departs from the first operating state thereof") can be sent to the control circuit 17 by the signal transducer 23, and a signal "rollup shutter rolled up completely" ("opening 5 completely uncovered") can be transmitted to the control circuit 17 by the signal transducer 21.

The signals outputted by the signal transducers 22 and 23 when the opening 5 is screened and when the respective screen 7, 7' departs from the first operating state thereof, respectively, can also be generated by a signal switch, if that switch has a suitable number of contacts.

Figure 7:
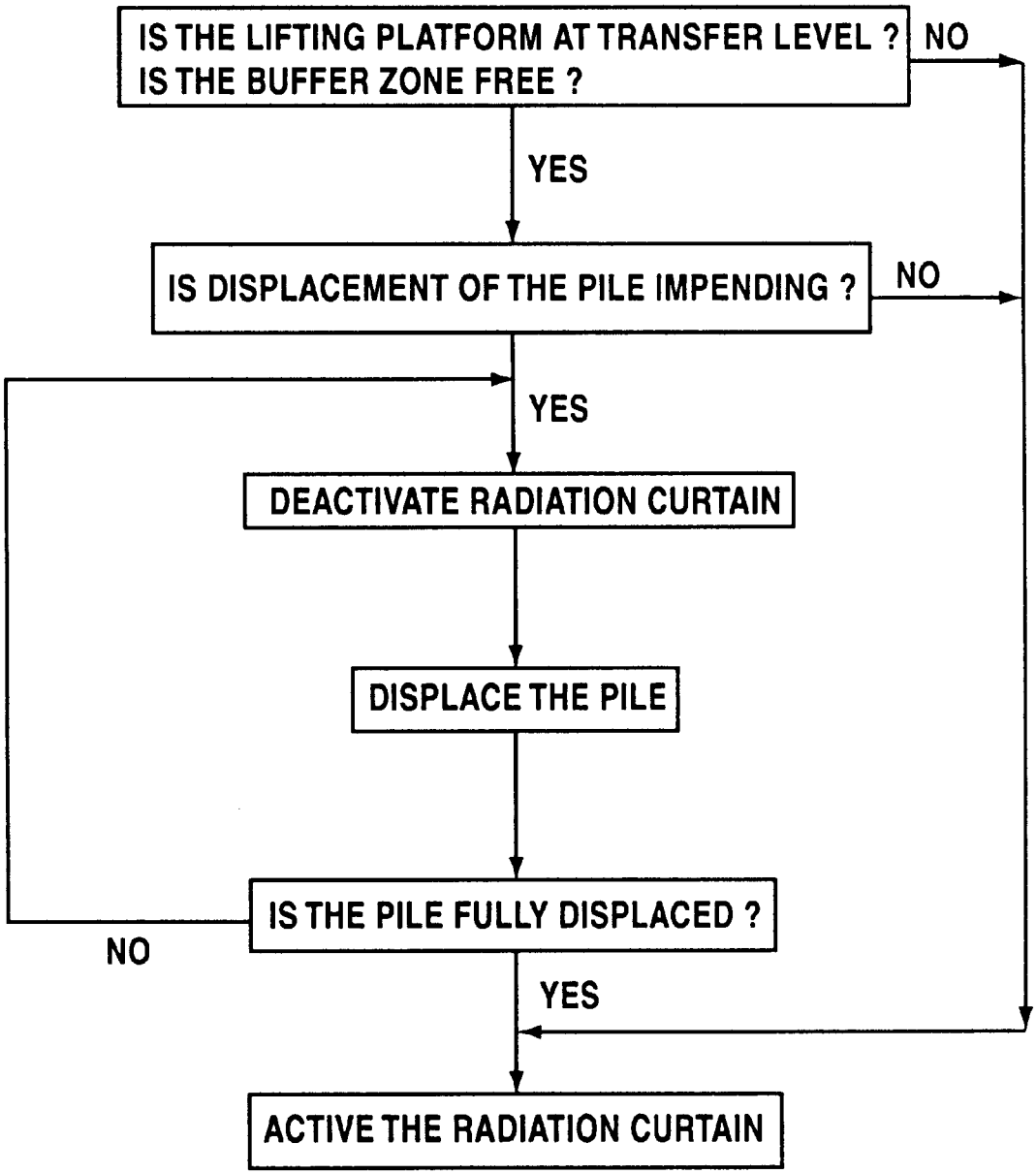
FIG. 7 is a flowchart of the operation of the pile-handling device when the sheet pile is shifted from the first conveyor subsection to the second conveyor subsection and the reverse, respectively, the screen of the device being constructed, for example, as a radiation curtain.

The flowchart of FIG. 7 for operating the device according to the invention when the pile 6 is shifted from the first conveyor subsection 11.1 to the second conveyor subsection 11.2 and the reverse, in the case wherein the screen 7" is embodied as the aforementioned radiation curtain, and in particular in the case wherein a radiation curtain formed of beams of light is used, employing an aforementioned photoelectric safety barrier, is realizable by a control system which is modified only as described further hereinbelow in comparison with the control system described hereinabove in conjunction with FIG. 4.

When such a photoelectric safety barrier is used, signal transducers corresponding to the signal transducers 21 and 22 are unnecessary. The signal "(external) intervention into the screen is taking place" which may be output by the signal transducer 23, if necessary or desirable, is then optionally outputted by the receiver console 7".2 belonging to the photoelectric safety barrier, so that this console 7".2 replaces the signal transducer 23, and the control circuit which links the remaining signal transducers and the receiver console 7".2, now acting as a signal transducer, to the other corresponding components of the device according to the invention is modified so that now, instead of triggering the pivot drive 7.2 or the rotary drive 7'.2 in the appropriate rotary direction as in the flow chart of FIG. 5, it deactivates the radiation curtain in accordance with the flow chart of FIG. 7, and thus simulates the state "opening uncovered", if the aforementioned preconditions for shifting the pile 6 are present in the form of corresponding signals of the remaining signal transducers 18, 19, 20, 24, 25, and activates the radiation curtain if the pile 6 has been completely shifted, which occurs, in turn, based upon the aforedescribed signals of remaining signal transducers (in this case the signal transducers 18 and 19 or 24 and 25, depending upon the direction of the shift).

By the term "deactivation", it should be understood here that the modified control circuit ignores a signal "(external) intervention into the screen is taking place" outputted by the receiver console 7".2, because the intended purpose of deactivation in the case at hand is that an intervention into the radiation curtain by the pile 6, as the latter passes through the opening 5, not be treated as a threatening external intervention into the screen. In the case of the activated radiation curtain, by comparison, the modified control circuit handles a signal "(external) intervention into the screen is taking place", which may be present, in the same way as the control circuit 17 explained in conjunction with FIG. 4; it thus, in particular, triggers the lifting motor 4.3 with a signal "stop lifting motor", if this motor had been triggered for a downwardly-oriented adjustment of the lifting platform 3 (note the flowchart in FIG. 8).

Figure 8:
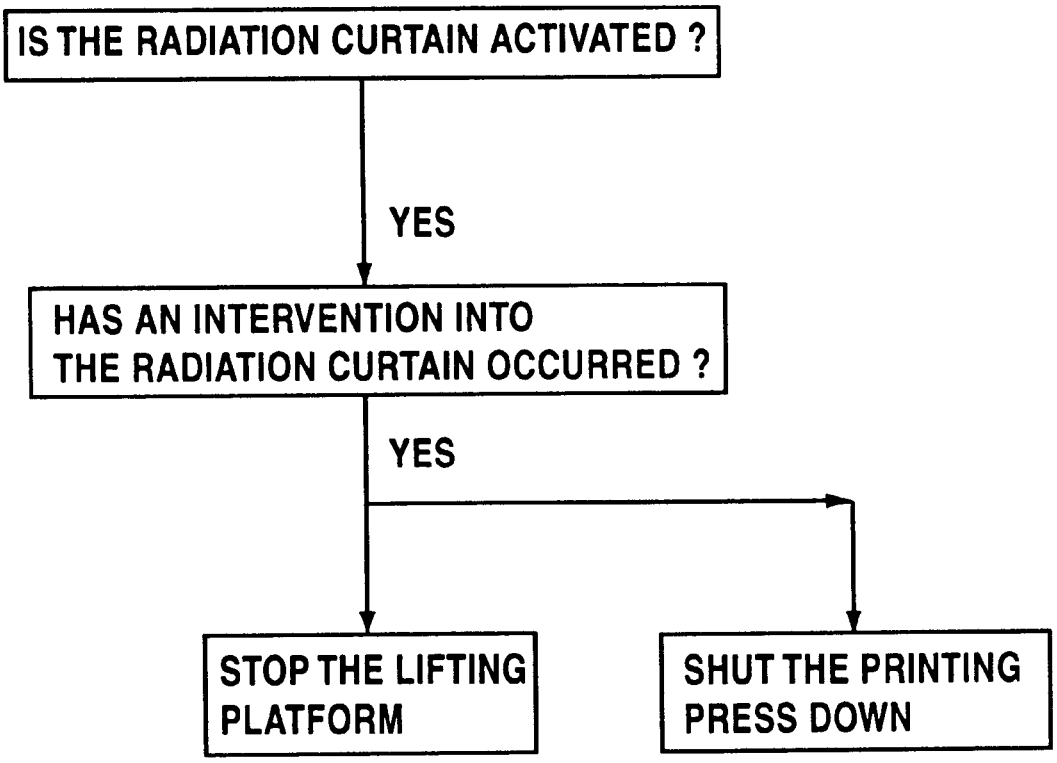
FIG. 8 is a flowchart of the operation of the pile-handling device wherein the screen of the device is constructed, for example, as a radiation curtain provided for meeting ever more stringent demands for safety, in the event of an engagement with or intervention into the radiation curtain during a production run of the printing press, and when a lift drive is optionally activated to adjust the lifting platform downwardly, respectively.

To meet more stringent safety demands in the aforementioned further construction, the modified control circuit, as suggested hereinbefore in FIG. 4, also triggers the main drive motor 16 of the printing press as in the flow chart of FIG. 8, specifically in such a manner that this control circuit, in the event of a signal "(external) intervention into the screen is taking place", which is outputted by the receiver bracket 7".2, in turn, outputs a emergency-stop signal, by which the main drive motor 16 and thus the aforementioned revolving gripper systems 10.1 are stopped, as long as a programmed shifting of the pile in accordance with the flow chart of FIG. 7 is not in progress.

The modification of the control circuit 17 for this purpose is not limited to the construction of the screen 7" to produce a radiation curtain. In the case of the mechanical screens 7 and 7', respectively, embodied as the gate 7.1 or rollup shutter 7'.1 and recognizable as a barrier, a realization of such a refinement can be considered dispensable, however, even in the case of the construction of a chain delivery in accordance with the device of the invention.

In the case wherein a sheet feeder is constructed in accordance with the device of the invention, there results, in contrast with a corresponding construction of a sheet delivery, in general, a reversal of the direction in which the pile 6 passes through the opening 5. This is indicated in FIG. 3 by arrows associated with the conveyor subsections. FIG. 3 should also be interpreted as representing the processing unit 8.1 as preceding the feeder, and the delivery as following the processing unit 8.n. Also shown in FIG. 3 is an occupancy state of the conveyor subsections wherein, in the case of the sheet feeder, the pile 6 is in the pile chamber and the buffer zone 12 is not occupied, and in the case of the sheet delivery, the buffer zone 12 is occupied by a pile 6 which has been removed from the pile chamber 2. In this case, in the uninterrupted production-run mode, pile formation in the delivery occurs initially on an auxiliary pile support, from which a partial pile formed thereon is then set down on an empty pile support (not shown in FIG. 3) which has been introduced into the pile chamber 2.

In the embodiment shown in FIG. 3, there is also provided a conveyor subsection located opposite the buffer zone 12 of the feeder, that conveyor subsection being capable of receiving a pile support from which the pile has been used up, and being removable through a non-illustrated disposal opening, corresponding to the charging opening 13 of the delivery mentioned hereinbefore, from the pile chamber of the feeder by the conveyor route or section drive (not shown in FIG. 3).

In a departure from what is shown in FIGS. 1 to 3, the predetermined occupancy state of the conveyor subsections, in the case of the delivery, as one of the criteria for an imminent shifting of the pile 6 and thus for the operationally independent change from the first operating state of the screen to the second operating state thereof is, in general, present when the buffer zone 12 of the delivery is not occupied by a pile 6 and, in the case of the feeder, when the buffer zone 12 of the feeder is occupied by a pile 5.

The control circuit 17 and the modified embodiment thereof may, however, also be constructed so that the change in operating states of the screen takes place both at the occupancy states of the conveyor subsections mentioned hereinabove and occupancy states differing therefrom.

Particularly at the feeder, this may be expedient whenever a pile unsuitable for the current job has been moved into the pile chamber by mistake.

We claim:

1. A device for handling a sheet pile in a printing press, comprising:

a pile chamber formed with at least one opening which is of a size at least through which a sheet pile is passable in a horizontal direction;

a lifting platform disposed in said pile chamber for receiving the sheet pile thereon;

a lift drive for vertically adjusting said lifting platform between an upper level and a lower level;

a protector associated with said at least one opening and being switchable between a first operating state wherein said protector protects said at least one opening, and a second operating state wherein said at least one opening is free from being protected by said protector;

a first conveyor subsection supported by said lifting platform disposed within said pile chamber;

at least a second conveyor subsection located adjacent to said at least one opening and adjoining said pile chamber, said first and second conveyor subsections having alternating states of occupancy during operation, wherein they are alternately occupied by the sheet pile and not occupied by the sheet pile, respectively, and said first conveyor subsection together with said second conveyor subsection forming a conveyor section when said lifting platform is at the lower level;

sheet pile conveyors provided in said first and said second conveyor subsections for conveying the sheet pile;

a conveyor section drive selectively switchable into an activated state and a deactivated state and driving said sheet pile conveyors when being in the activated state;

a plurality of first detectors for generating respective first signals in response to the alternating states of occupancy;

a second detector for generating a second signal when said lifting platform is at the lower level; and a control circuit connected to said conveyor section drive, to said plurality of first detectors, and to said second detector for switching said protector between the first and the second operating state thereof, said control circuit processing the first signals and the second signal such that, for predetermined states of occupancy of said first and said second conveyor subsections and when said lifting platform is at the lower level, said protector is switched from the first operating state thereof to the second operating state, and such the said conveyor siction drive is activated and said protector is switched from the second operating state to the first operating state after said conveyor section drive has caused a change in the states of occupancy.

2. The handling device according to claim 1, including a signal generator cooperating with said protector and being adapted to generate a stop signal when said protector departs from the first operating state thereof, at least said lift drive being triggerable by said stop signal for shutting said lift drive down when an adjustment of said lifting platform is in progress.

3. The handling device according to claim 1, wherein said protector comprises a gate.

4. The handling device according to claim 1, wherein said protector comprises a rollup shutter.

5. The handling device according to claim 1, wherein said protector includes a transmitter transmitting a radiation for forming a radiation curtain, and a receiver receiving the radiation, said receiver being adapted to generate a stop signal when an intervention into said radiation curtain occurs, at least said lift drive being triggerable by said stop signal for shutting said lift drive down when an adjustment of said lifting platform is in progress.

6. The handling device according to claim 5, wherein said receiver is adapted to generate an emergency-stop signal when an intervention into said radiation curtain occurs, said emergency-stop signal being applicable for shutting a printing press down.

7. A device for handling a sheet pile in a printing press, comprising:

a pile chamber formed with at least one opening which is of a size at least through which a sheet pile is passable in a horizontal direction;

a lifting platform disposed in said pile chamber for receiving the sheet pile thereon;

a lift drive for vertically adjusting said lifting platform;

a protector assigned to said at least one opening and being adjustable between a first operating state wherein said protector protects said at least one opening, and a second operating state wherein said at least one opening is free from being protected by said protector;

a conveyor section for horizontally shifting the sheet pile through said at least one opening when said lifting platform is at a transfer level, said conveyor section including a first conveyor subsection disposed within said pile chamber and at least a second conveyor subsection located outside and adjoining said pile chamber, said first and second conveyor subsections having alternating states of occupancy during operation, wherein they are alternately occupied by the sheet pile and not occupied by the sheet pile, respectively;

a conveyor section drive for shifting the sheet pile along said conveyor section;

said protector being automatically changeable from the first to the second operating state thereof for predetermined states of occupancy of said first and said second conveyor subsections and when said lifting platform is at the transfer level and, said protector being automatically changeable from the second to the first operating state thereof after the sheet pile has been shifted completely from one of said first and second conveyor subsections to the other thereof; and a signal generator cooperating with said protector and being adapted to generate a stop signal when said protector departs from the first operating state thereof, at least said lift drive being triggerable by said stop signal for shutting said lift drive down when an adjustment of said lifting platform is in progress.

8. A device for handling a sheet pile in a printing press, comprising:

a pile chamber formed with at least one opening which is of a size at least through which a sheet pile is passable in a horizontal direction;

a lifting platform disposed in said pile chamber for receiving the sheet pile thereon;

a lift drive for vertically adjusting said lifting platform;

a protector assigned to said at least one opening and being adjustable between a first operating state wherein said protector protects said at least one opening, and a second operating state wherein said at least one opening is free from being protected by said protector;

a conveyor section for horizontally shifting the sheet pile through said at least one opening when said lifting platform is at a transfer level, said conveyor section including a first conveyor subsection disposed within said pile chamber and at least a second conveyor subsection located outside and adjoining said pile chamber, said first and second conveyor subsections having alternating states of occupancy during operation, wherein they are alternately occupied by the sheet pile and not occupied by the sheet pile, respectively;

a conveyor section drive for shifting the sheet pile along said conveyor section; and said protector being automatically changeable from the first to the second operating state thereof for predetermined states of occupancy of said first and said second conveyor subsections and when said lifting platform is at the transfer level and, said protector being automatically changeable from the second to the first operating state thereof after the sheet pile has been shifted completely from one of said first and second conveyor subsections to the other thereof, said protector including a transmitter transmitting a radiation for forming a radiation curtain and a receiver receiving the radiation, said receiver being adapted to generate a stop signal when an intervention into said radiation curtain occurs, at least said lift drive being triggerable by said stop signal for shutting said lift drive down when an adjustment of said lifting platform is in progress.

9. The handling device according to claim 8, wherein said receiver is adapted to generate an emergency-stop signal when an intervention into said radiation curtain occurs, said emergency-stop signal being applicable for shutting a printing press down.

* * * * *